US009562707B2

(12) United States Patent
Wu

(10) Patent No.: US 9,562,707 B2
(45) Date of Patent: Feb. 7, 2017

(54) REFRIGERATOR COOLING SYSTEM HAVING A SECONDARY COOLING LOOP

(71) Applicant: Whirlpool Corporation, Benton Harbor, MI (US)

(72) Inventor: Guolian Wu, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 778 days.

(21) Appl. No.: 13/827,305

(22) Filed: Mar. 14, 2013

(65) Prior Publication Data

US 2014/0260356 A1 Sep. 18, 2014

(51) Int. Cl.
*F25D 11/02* (2006.01)
*F25B 25/00* (2006.01)
*F25D 11/00* (2006.01)

(52) U.S. Cl.
CPC ..... *F25B 25/005* (2013.01); *F25D 11/006* (2013.01); *F25D 11/025* (2013.01); *F25B 2400/24* (2013.01)

(58) Field of Classification Search
CPC ... F25B 25/005; F25B 2400/24; F25D 11/006; F25D 11/025; F25D 3/005
See application file for complete search history.

(56) References Cited

U.S. PATENT DOCUMENTS 2,515,825 A 7/1950 Grant
6,973,799 B2 12/2005 Kuehl et al.
7,610,773 B2 11/2009 Rafalovich et al.
7,980,093 B2 7/2011 Kuehl et al.
8,099,975 B2 1/2012 Rafalovich et al.
2004/0139757 A1* 7/2004 Kuehl ..... B60H 1/00592 62/237
2009/0158768 A1 6/2009 Rafalovich
2009/0165491 A1* 7/2009 Rafalovich ..... F25C 1/04 62/344
2009/0260371 A1 10/2009 Kuehl et al.
2009/0266089 A1 10/2009 Haussmann
2011/0011119 A1 1/2011 Kuehl et al.
2011/0072849 A1* 3/2011 Kuehl ..... F04B 35/04 62/498
2012/0266627 A1* 10/2012 Lee ..... F25D 17/02 62/452

FOREIGN PATENT DOCUMENTS

JP 200453055 A 2/2004
KR 200018796 A 1/2000
KR 1020110032611 * 3/2011 ..... F25D 11/02

OTHER PUBLICATIONS

European Search Report, Application No. 14158152.0, dated Sep. 14, 2015.

* cited by examiner

*Primary Examiner* — Cassey D Bauer

(57) ABSTRACT

A refrigerator cooling system and method provides cooling to one or more features of a refrigerator by employing a secondary cooling loop that utilizes the excess cooling capacity of an evaporator to selectively provide supplemental cooling to the features when a thermal demand arises.

12 Claims, 6 Drawing Sheets

REFRIGERATOR COOLING SYSTEM HAVING A SECONDARY COOLING LOOP

FIELD OF THE INVENTION

The present invention generally relates to the field of refrigeration and more specifically relates to refrigerators employing dual evaporator systems.

SUMMARY OF THE INVENTION

According to one aspect of the present invention, a cooling system for use in a refrigerator is provided and includes: a first cooling loop having a compressor configured to compress coolant, a condenser operably connected to the compressor, a valving system operably connected to the condenser and configured to selectively provide coolant to a first evaporator thermally connected with a first refrigerator compartment and a second evaporator thermally connected to a second refrigerator compartment; and a secondary cooling loop in non-fluid contact with the first cooling loop and having a reservoir that is thermally connected to the first evaporator and stores a liquid thermal storage material that receives excess cooling capacity from the first evaporator, a heat exchanger thermally connected to a feature positioned within the first compartment, and a pump operably connected to the reservoir that pumps the liquid thermal storage material to the heat exchanger to provide cooling to the feature.

According to another aspect of the present invention, a cooling system for use in a refrigerator is provided and includes: a first cooling loop having a compressor configured to compress coolant, a condenser operably connected to the compressor, a valving system operably connected to the condenser and configured to selectively provide coolant to a first evaporator thermally connected with a fresh food compartment and a second evaporator thermally connected to a freezer compartment; a secondary cooling loop in non-fluid contact with the first cooling loop and having a reservoir that is thermally connected to the first evaporator and stores a liquid thermal storage material that receives excess cooling capacity from the first evaporator, a heat exchanger thermally connected to a feature positioned within the fresh food compartment, and a pump operably connected to the reservoir that pumps the liquid thermal storage material to the heat exchanger to provide cooling to the feature; and a controller configured to control the flow of coolant through the first evaporator to thereby control the cooling provided to the liquid storage thermal material stored in the reservoir.

According to another aspect of the present invention, a cooling system for use in a refrigerator is provided and includes: a first cooling loop having a compressor configured to compress coolant, a condenser operably connected to the compressor, a valving system operably connected to the condenser and configured to selectively provide coolant to a first evaporator thermally connected with a fresh food compartment and a second evaporator thermally connected to a freezer compartment; a secondary cooling loop in non-fluid contact with the first cooling loop and having a reservoir that is thermally connected to the first evaporator and stores a liquid thermal storage material that receives excess cooling capacity from the first evaporator, a heat exchanger thermally connected to a feature positioned within the fresh food compartment, a pump operably connected to the reservoir that pumps the liquid thermal storage material to the heat exchanger to provide cooling to the feature, and a bypass circuit configured to selectively provide the liquid thermal storage material to at least one of the plurality of heat exchangers while bypassing the other of the plurality of the heat exchangers in instances where a thermal demand arise in at least one of the plurality of features; and a controller configured to control the flow of coolant through the first evaporator to thereby control the cooling provided to the liquid storage thermal material stored in the reservoir.

According to another aspect of the present invention, a method for providing cooling to a feature positioned in a fresh food compartment of a refrigerator is provided and includes the steps of: providing a first cooling loop having a compressor that compresses coolant, a condenser operably connected to the compressor, and a valving system that selectively provides coolant to a first evaporator thermally connected to the fresh food compartment and a second evaporator thermally connected to a freezer compartment of the refrigerator; providing a secondary cooling loop in non-fluid contact with the first cooling loop and having a reservoir thermally connected to the first evaporator that stores a liquid thermal storage material and a heat exchanger thermally connected to the feature; cooling the liquid thermal storage material with the excess cooling capacity from the first evaporator; pumping the liquid thermal storage material to the heat exchanger to provide cooling to the feature; and using a controller to control the flow of coolant through the first evaporator to thereby control the cooling provided to the liquid thermal storage material stored in the reservoir.

These and other aspects, objects, and features of the present invention will be understood and appreciated by those skilled in the art upon studying the following specification, claims, and appended drawings.

DETAILED DESCRIPTION OF THE PREFERRED EMBODIMENTS

As required, detailed embodiments of the present invention are disclosed herein. However, it is to be understood that the disclosed embodiments are merely exemplary of the invention that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present invention.

Figure 1:
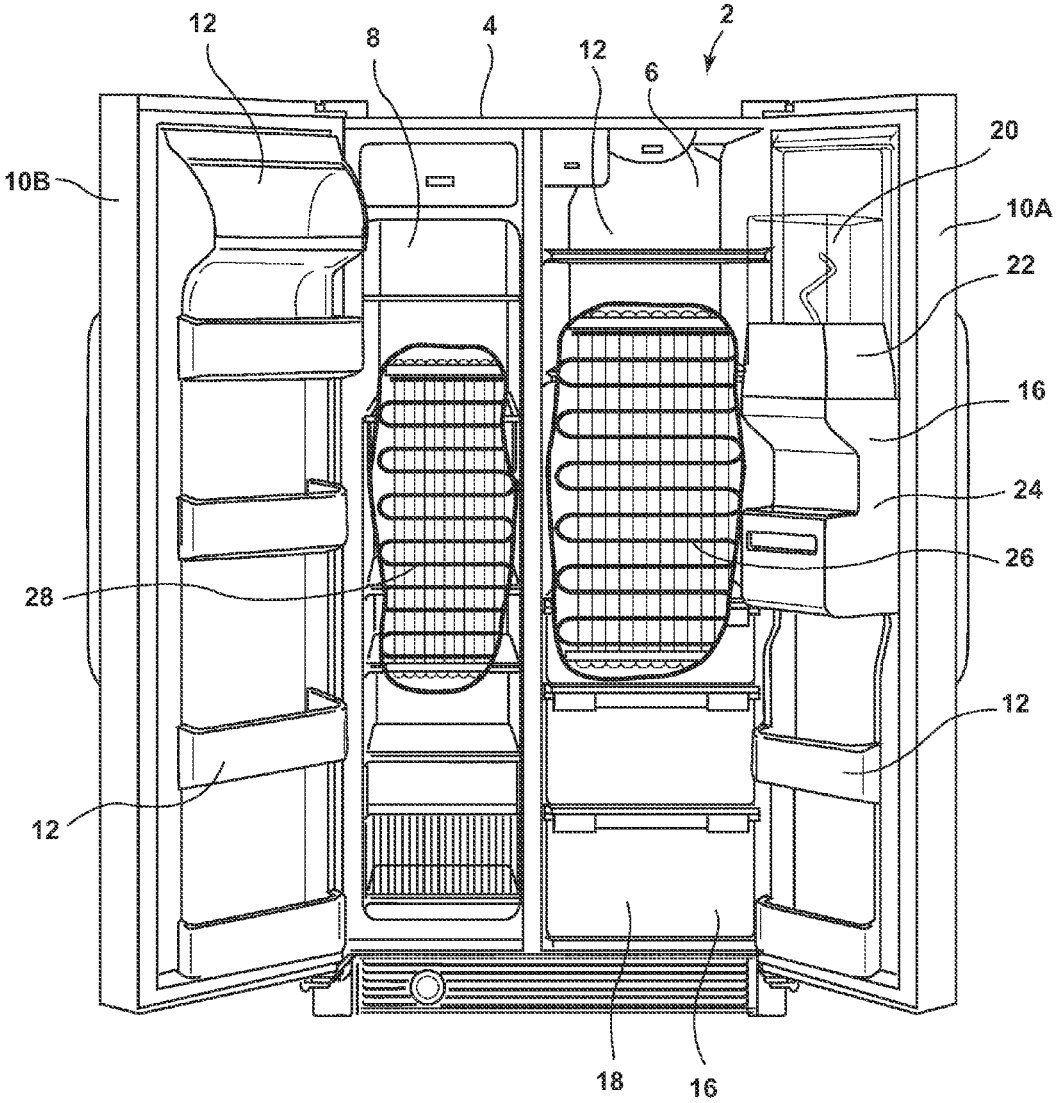
FIG. 1 is a perspective view of a general "side by side" refrigerator employing a dual evaporator cooling system and having a variety of features.

Referring now to FIG. 1, a refrigerator 2 according to one aspect of the present invention has a "side by side" configuration that includes a body 4 having a fresh food compartment 6 and a freezer compartment 8. As discussed in more detail below, compartments 6 and 8 may be maintained at different temperatures. Compartments 6 and 8 can be selectively closed off in a known manner by hinged doors 10A and 10B, respectively. However, any configuration of appliance such as top mount freezer, bottom mount freezer, and French door bottom mount freezer configurations may be utilized in accordance with the present invention.

As shown in FIG. 1 a variety of compartmental areas 12 may be provided in each compartment 6, 8 as well as the doors 10A and 10B for supporting various items. Compartment 6 and/or 8 may include one or more modules 16 that provide a variety of conveniences and uses. To properly operate, some of these modules 16 may require operating utilities such as cooling and electrical power. For example, a crisper 18 may be provided within the fresh food compartment 6 for storing fresh fruits and vegetables. An icemaker 20 may be provided within the freezer compartment or more typically on the interior of the door 10 of the fresh food compartment 6. A water chiller 22 and a water/ice dispenser 24 may also be provided on the door 10 in proximity to the icemaker 20 to enable chilled water and/or ice to be dispensed.

Refrigerator 2 may include one or more evaporators that provide cooling capacity to independently maintain compartments 6 and 8 at selected temperatures. For example, a first evaporator 26 may be configured to provide cooling of the fresh food compartment 6 and a second evaporator 28 may be configured to provide cooling of the freezer compartment 8. The evaporators 26 and 28 need not necessarily be positioned in the respective compartments 6 and 8 to provide cooling to the same and can be positioned in other suitable locations of the refrigerator 2. Since compartments 6 and 8 typically operate at different temperatures, each evaporator 26, 28 is adapted to provide cooling based on the thermal demands of each respective compartment 6, 8. In some instances, the first evaporator 26 may provide a surplus cooling capacity relative to the requirements of compartment 6. In prior systems, surplus cooling capacity may produce unwanted temperature fluctuations in a fresh food compartment. As a result, in prior known systems, it may be difficult to provide efficient thermal regulation because an evaporator having excess cooling capacity cannot be consistently operated a desired temperature.

Figure 2:
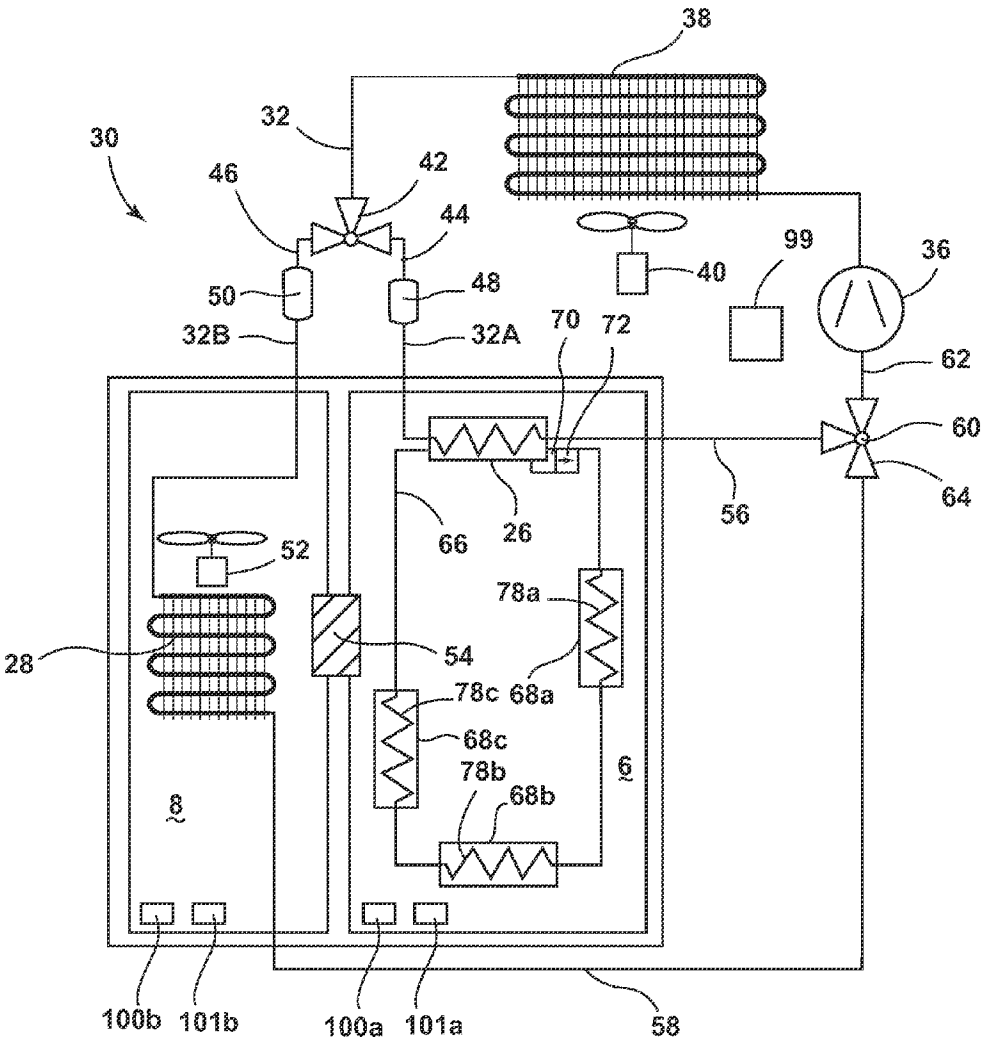
FIG. 2 is a schematic view of a refrigeration system according to one aspect of the present invention.

Referring now to FIG. 2, a refrigeration cooling system 30 according to one aspect of the present invention is a sequential multi (dual) evaporator cooling system that provides the first evaporator 26 with cooling assistance so that the first evaporator 26 may be operated, typically consistently operated, at a desired temperature and a second evaporator 28 so that the second evaporator 28 may be operated, typically consistently operated, at a desired temperature. The refrigeration cooling system 30 includes a first cooling loop 32 that circulates coolant (e.g. gas or liquid fluid), throughout the refrigerator 2 for providing cooling to the fresh food compartment 6 and the freezer compartment 8. As discussed below, first cooling loop 32 includes a first portion 32A that cools compartment 6, and a second portion 32B that cools compartment 8. First and second portions 32A and 32 B are arranged in parallel. First cooling loop 32 also includes a compressor 36 that compresses the coolant. The heated/high pressure coolant flows to a condenser 38 that is cooled by a fan 40. As the coolant passes through the condenser 38, the temperature of the coolant drops, and the coolant then flows to a first three-way valve 42 that selectively controls the flow of coolant through a first conduit 44 of first portion 32A and a second conduit 46 of second portion 32B. Coolant circulating through the first conduit 44 passes through a first throttling device 48, such as a capillary tube that causes the compressed coolant to expand and cool. The coolant then flows to the first evaporator 26 of the fresh food compartment 6. Likewise, coolant circulating through the second conduit 46 passes through a second throttling device 50 (e.g. capillary tube) and expands and cools. The coolant then flows to the second evaporator 28 of the freezer compartment 8. As coolant passes through the second evaporator 28, an evaporator fan 52 causes air to flow over the second evaporator 28 to cool the air, and the cooled air is circulated through the freezer compartment 8. For instances where excess cold air is also passed into the fresh food compartment 6, a damper assembly 54 can be utilized to control the air flow between compartments 6 and 8.

A controller 99 may be operably connected to temperature sensors 100*a* and 100*b* in compartments 6 and 8, respectively. The controller 99 may be configured to selectively open damper 54 to selectively permit air flow between compartments 6 and 8 according to predefined criteria. For example, controller 99 may be operably connected to thermostats 101*a* and 101*b* in compartments 6 and 8, respectively. If the measured temperatures of compartments 6 and 8 are sufficiently different than the control temperature settings of thermostats 101*a* and 101*b*, and if a temperature differential exists between compartments 6 and 8, controller 99 may open damper 54 to permit air flow (e.g. heat transfer) between compartments 6 and 8 to cause the temperature to shift to/towards the control temperatures.

The coolant exiting the first evaporator 26 flows through a first suction line 56 to a junction 60 and coolant exiting the second evaporator 28 flows through a second suction line 58 to junction 60. Coolant from the first and second suction lines 56 and 58 flows through junction 60 and then to the compressor 36 via a third suction line 62 connected to the junction 60 outlet. Junction 60 may comprise a second three-way valve 64 that selectively controls the flow of coolant from suction lines 56 and 58 to the third suction line 62. Three-way valve 64 may comprise a powered unit that is operably connected to controller 99. Alternatively, the first and second suction lines 56, 58 may feed directly into a dual suction compressor.

The first portion 32A of first cooling loop 32 is thermally connected to a secondary cooling loop 66 of the fresh food compartment 6 by evaporator 26. The secondary cooling loop 66 is not fluidly connected to the first cooling loop 32. Evaporator 26 provides for heat transfer between the coolant of first cooling loop 32 and the liquid circulating in the secondary cooling loop 66. Liquid is stored in a reservoir 70 that is thermally connected to evaporator 26 and receives excess cooling capacity from evaporator 26. A pump 72 is operably connected to the reservoir 70 and pumps cooled liquid to any number of heat exchangers (shown as three heat exchangers 78*a*, 78*b*, and 78*c* in FIG. 2) to provide cooling to any number of features, but typically a corresponding number of features (shown as features 68*a*, 68*b*, and 68*c* in FIG. 2) of the refrigerator. The features are thermally connected to the heat exchangers of the secondary loop 66. Controller 99 may be configured to supply coolant to the evaporator 26 only when liquid stored in the reservoir 70 lacks sufficient thermal capacity to provide the desired rate of heat transfer at heat exchangers 78*a*, 78*b*, and 78*c* to cool features 68*a*, 68*b*, and 68*c*.

Features 68*a*, 68*b*, and 68*c*, in addition to other features presented in subsequent embodiments may include the compartmental areas 12, and/or the modules 16 of the fresh food compartment 6, such as a quick chill or deep chill module and may be provided throughout the fresh food compartment 6 including door 10A. Thus, with the presence of the secondary cooling loop 66, the placement of features 68*a*, 68*b*, 68*c*, and subsequently presented features do not directly depend on the location of the first evaporator 26. As a result, the first evaporator 26 may be positioned such that it takes up less space in the refrigerator, thereby providing space saving opportunities relative to the volume and/or space typically available to refrigeration configurations. Furthermore, the use of the secondary cooling loop 66 to fulfill cooling needs temporarily relieves the compressor 36 from having to circulate coolant to the first evaporator 26 thereby reducing the possibility of overcooling and excess energy usage. For example, in use, controller 99 may cause three-way valve 42 to temporarily stop flow of coolant through first portion 32A of first cooling loop 32, while causing coolant to continue to flow through second portion 32B of first loop 32. Compressor 36 thereby continues to cool compartment 8, and compartment 6 is cooled by liquid circulating through secondary cooling loop 66 due to pump 72. The thermal capacity of the liquid of secondary cooling loop 66 permits significant cooling of compartment 6 even if evaporator 26 is not continuously cooling the liquid of secondary cooling loop 66. As a result, the refrigerator cooling system 30 disclosed herein is "Smart Grid friendly." For example, the refrigerator cooling system 30 may be configured to operably connect with an electrical grid that uses information and communication technology to gather and act on information, such information typically including information about behavior of suppliers and customers.

Figure 3:
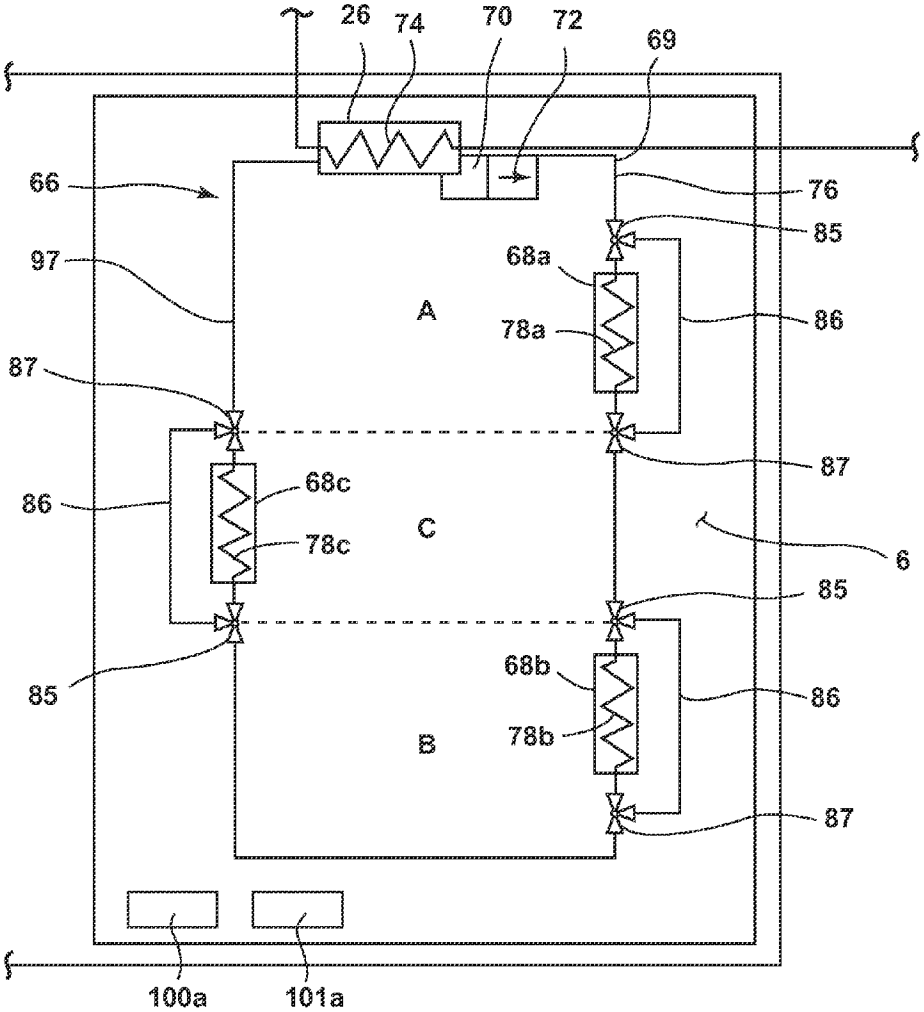
FIG. 3 is schematic view of a secondary cooling loop having a series configuration.

Referring now to FIG. 3, one exemplary embodiment of the secondary cooling loop 66 is shown having a bypass circuit 69 configured to selectively provide cooled liquid stored in the reservoir to one or more of heat exchangers 78*a*, 78*b*, and 78*c* when a thermal demand arises in one or more of features 68*a*, 68*b*, and 68*c*. Additionally, the bypass circuit 69 may be operably connected to controller 99 to aid controller 99 in determining when to initiate delivery of coolant to evaporator 26 based on the thermal demand on features 68*a*, 68*b*, and 68*c* in relation to the cooling capacity of the liquid being stored and/or circulated in the secondary cooling loop 66. In this embodiment, the secondary cooling loop 66 contains a liquid thermal storage material such as water, brine, or any other suitable liquid coolant. Cooled liquid thermal storage material can be circulated through the secondary cooling loop 66 by natural or forced convection. In this embodiment, pump 72 drives each pass of the liquid thermal storage material through the secondary cooling loop 66 to provide cooling to features 68*a*, 68*b*, and 68*c* of the fresh food compartment 6 that may be located at proximal and remote distances relative to the first evaporator 26. In between passes, the returning liquid thermal storage material is temporarily stored and cooled in reservoir 70. The first evaporator 26 may include a coupler 74, such as one or more evaporator tubes, thermally connected to the reservoir 70 and including a conductive interface for transferring excess cooling capacity from the first evaporator 26 to the secondary cooling loop 66 for cooling the stored liquid thermal storage material in the reservoir 72. To reduce interfacial resistance, the coupler 74 interface may include a thermally conductive material such as copper or aluminum. Additionally, the secondary cooling loop 66 may include insulators such as polyurethane foam or vacuum insulation for preventing undesired thermal transfers.

When a cooling need arises, the cooled liquid thermal storage material in reservoir 70 is pumped through a supply line 76 to heat exchangers 78*a*, 78*b*, and 78*c*. In the embodiment of FIG. 3, the cooled liquid thermal storage material first reaches heat exchanger 78*a* disposed within a first section A of the fresh food compartment 6. Heat exchanger 78*a* is thermally connected to feature 68*a*. Valve 85 (e.g. three-way valve) is selectively operated to either allow the cooled liquid thermal storage material to provide cooling capacity to the heat exchanger 78*a* or to bypass around the heat exchanger 78*a* via a bypass line 86 if the thermal demands of the feature 68*a* are met. Once the chosen course of action is completed, the liquid thermal storage material leaves via valve 87 (e.g. three-way valve). The cooling process proceeds in a similar fashion to selectively provide cooling to heat exchangers 78*b* and 78*c* that are thermally connected to features 68*b* and 68*c*, respectively.

For exemplary purposes, heat exchangers 78*b* and 78*c* may be provided in a second and third section B, C of the fresh food compartment 6. Upon completion of each cooling pass, the liquid thermal storage material returns to reservoir 70 via a return line 97 to receive cooling from the first evaporator 26 if needed. Thus, employing a circuit with bypassing capabilities ensures that liquid thermal storage material is only circulated when one or more features 68*a*, 68*b*, 68*c* require cooling. From this, more advanced cooling schemes can be devised based on the thermal demands of features 68*a*, 68*b*, and 68*c*. For example, the cooling process may be prioritized in an order of increasing thermal demands, such that in instances where more than one feature requires cooling, the feature with the highest thermal demands wins out and is first to receive cooling.

To assist with the cooling process, a variety of heat exchanger arrangements can be contemplated. For example, heat exchangers 78*a*, 78*b*, and 78*c* can be connected in series, in parallel, or in series and parallel combinations depending on the desired location and thermal demand features 68*a*, 68*b*, and 68*c*. Likewise, the present invention also contemplates other possible configurations of the secondary cooling loop 66. For example, the secondary cooling loop 66 can also be adapted for exclusive use in the freezer compartment 8 or for combinational use between the fresh food and freezer compartments 6, 8. To better illustrate these principles, particular reference is given to FIGS. 4 and 5, wherein the secondary cooling loop 66 with the bypass circuit 69 is generally shown providing a plurality of heat exchangers 78*a*, 78*b*, 78*c*, 78*d*, 78*e*, 78*f* in a parallel and a series and parallel arrangement and may be adapted for use in either or both compartments 6, 8.

Figure 4:
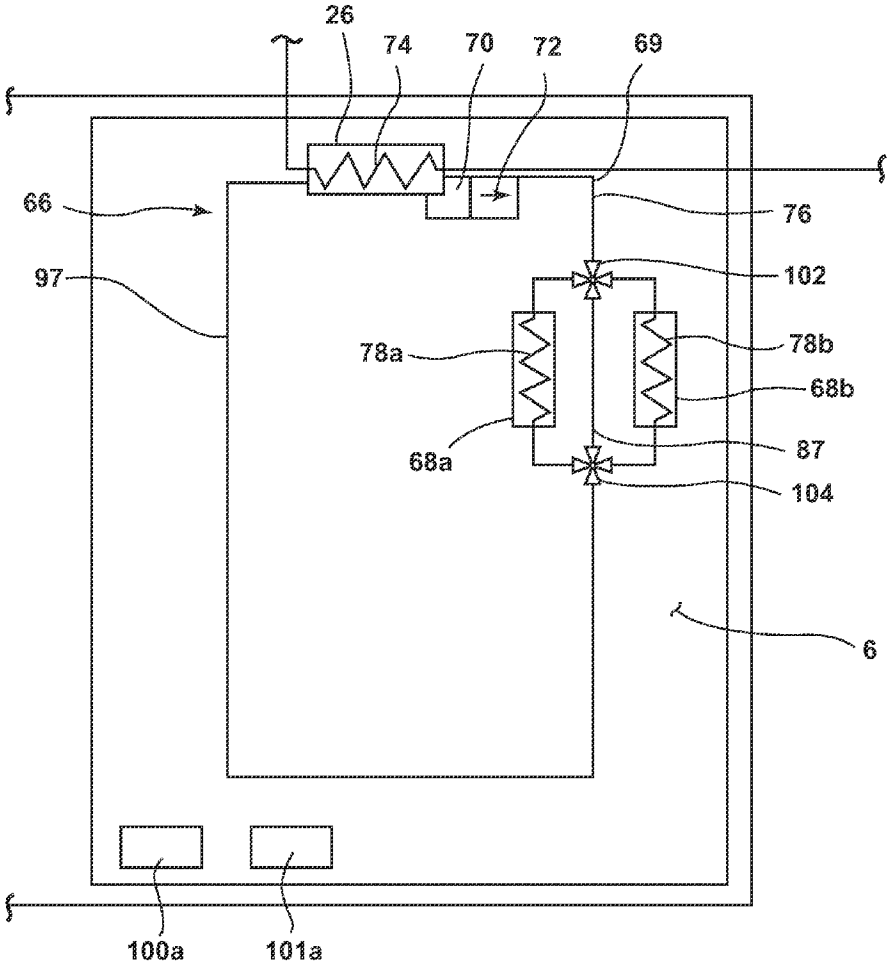
FIG. 4 is a schematic view of a secondary cooling loop having a parallel configuration.
Figure 5:
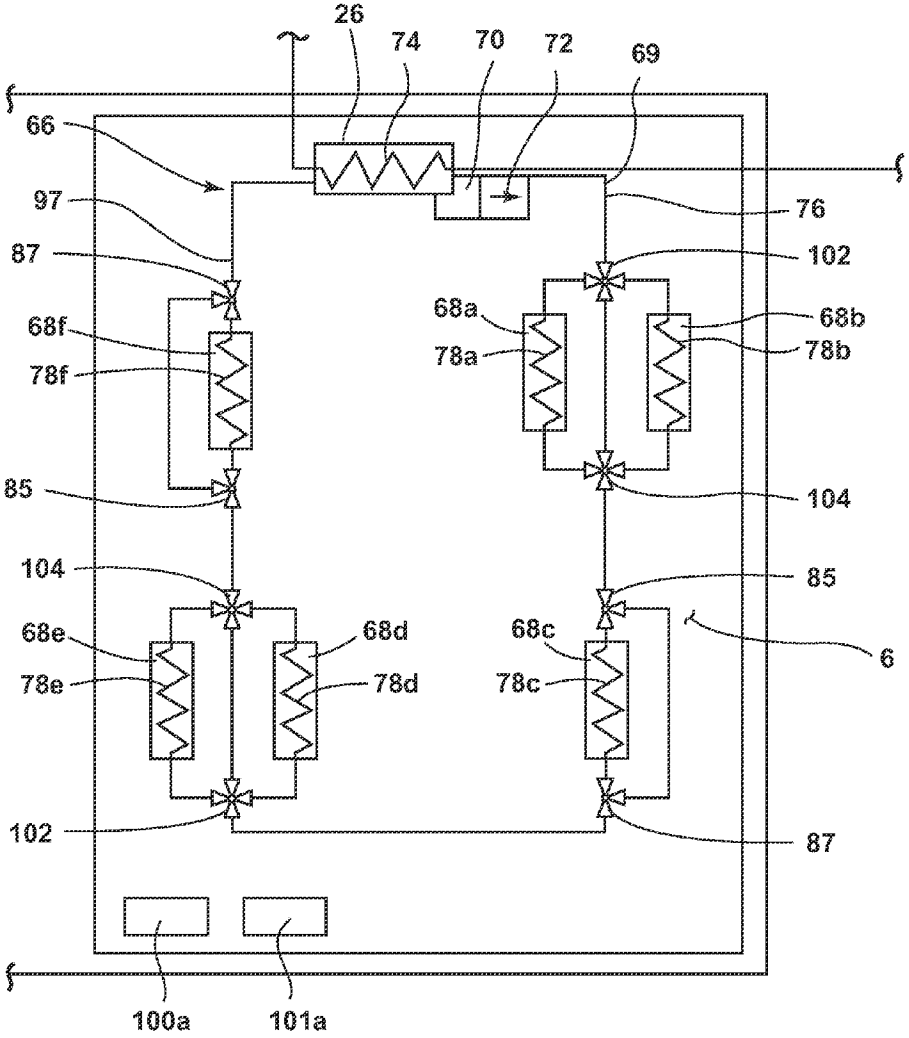
FIG. 5 is a schematic view of a secondary cooling loop having a series and parallel configuration.

As shown in FIG. 4, heat exchangers 78*a* and 78*b* are positioned in parallel to illustrate an instance where it may be desirable to allow cooled liquid thermal storage material to be simultaneously provided one or more heat exchangers. Depending on the thermal demands of features 68*a* and 68*b*, valve 102 (e.g. four-way valve) is operable to selectively provide liquid thermal storage material to only one of heat exchangers 78*a* and 78*b*, to both, or to none, in which case the liquid thermal storage material passes through the bypass line 86. Once the selected cooling procedure has been performed, the liquid thermal storage material exits through valve 104 (e.g. four-way valve) and continues to the next heat exchanger or returns to the reservoir 70 for cooling via the return line 97. As shown in FIG. 5, subsequent heat exchangers 78*c*, 78*d*, 78*e*, and 78*f* may be configured in series and/or in parallel to produce bypass circuits 69 with greater complexity.

Figure 6:
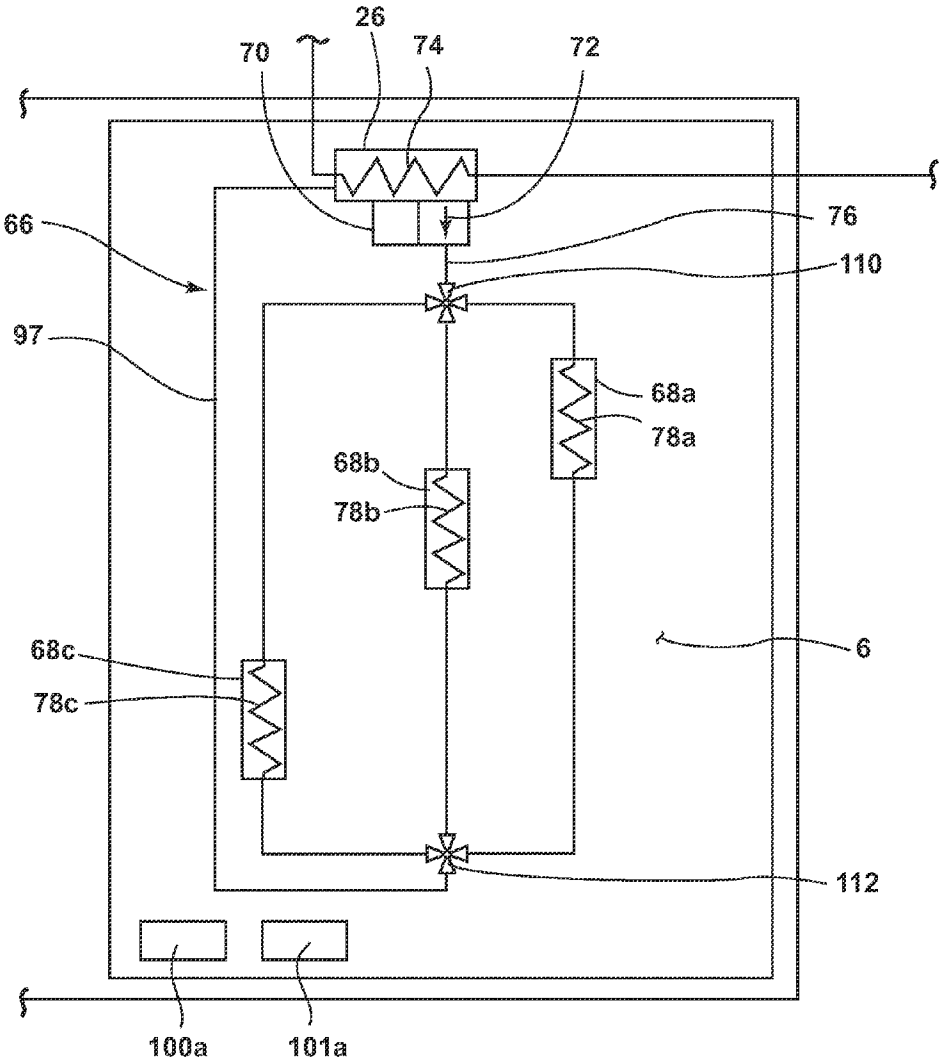
FIG. 6 is an alternative embodiment of the secondary cooling loop having a parallel configuration.

Referring now to FIG. 6, an alternative embodiment of the secondary cooling loop 66 is shown, wherein each of heat exchangers 78*a*, 78*b*, and 78*c* are configured in parallel with respect to one another. In this configuration, liquid thermal storage material is pumped through supply line 76 and passes through valve 110 (e.g. four-way valve) and can be provided to only one of heat exchangers 78*a*, 78*b*, and 78*c* or any combination thereof to provide cooling to features 68*a*, 68*b*, and 68*c*. Liquid thermal storage material then exits through valve 112 and returns to the reservoir 70 to receive additional cooling from evaporator 26 and/or be stored. In this embodiment, heat exchangers 78*a*, 78*b*, and 78*c* may be positioned in different regions of the refrigerator. For example, heat exchanger 78*a* may be positioned in the region corresponding to section A of FIG. 3, heat exchanger 78*b* may be positioned in the region corresponding to section C of FIG. 3, and heat exchanger 78*c* may be positioned in the region corresponding to section B of FIG. 3. In this manner, each of the heat exchangers 78*a*, 78*b*, 78*c* may readily receive cooled liquid thermal storage material without the need for a bypass circuit. It is understood that additional heat exchangers may be added to the secondary loop 66 embodiment of FIG. 6 and positioned using any of the previously described configurations. However, doing so may result in the need for a bypass circuit to ensure that sufficient cooled liquid thermal storage material is capable of being provided to each heat exchanger.

From the above-described embodiments, those skilled in the art should appreciate that the secondary cooling loop 66 may be utilized in different heat exchanger configurations depending on the requirements of a particular application. In general, due to the ability to simultaneously cool two or more features, parallel configurations may provide superior cooling versatility and control for some cooling applications. A series configuration is generally simpler, but may not provide the same degree of versatility and control. Thus, to maximize overall circuit efficiency, the location, size, and capacity of the cooling system components may be selected based on the requirements of a particular cooling application.

Accordingly, a refrigerator cooling system has been advantageously described herein. The refrigerator cooling system can selectively provide cooling to a variety of features located throughout the refrigerator resulting in more efficient thermal regulation.

It is to be understood that variations and modifications can be made on the aforementioned structures without departing from the concepts of the present invention, and further it is to be understood that such concepts are intended to be covered by the following claims unless these claims by their language expressly state otherwise.

What is claimed is:

1. A cooling system for use in a refrigerator, comprising:

a first cooling loop having a compressor configured to compress coolant, a condenser operably connected to the compressor, a valving system operably connected to the condenser and configured to selectively provide coolant to a first evaporator thermally connected to a first refrigerator compartment and a second evaporator thermally connected to a second refrigerator compartment; and a secondary cooling loop in non-fluid contact with the first cooling loop and having a reservoir that is thermally connected to the first evaporator and stores a liquid thermal storage material that receives excess cooling capacity from the first evaporator, a plurality of heat exchangers thermally connected to a plurality of features positioned within the first compartment, and a pump operably connected to the reservoir that pumps the liquid thermal storage material to the plurality of heat exchangers to provide cooling to the plurality of features;

wherein the plurality of heat exchangers are positioned relative to one another in the secondary cooling loop in a series, parallel, or series-parallel configuration;

wherein the secondary cooling loop further comprises a bypass circuit operably connected to a controller and configured to selectively provide the liquid thermal storage material to at least one of the plurality of heat exchangers while bypassing the other of the plurality of heat exchangers in instances where a thermal demand arises in the at least one of the plurality of features; and wherein the bypass circuit provides liquid thermal storage material to the plurality of heat exchangers based on the thermal demand of the plurality of features, wherein the plurality of features having the highest thermal demand are first to receive cooling.

2. The cooling system of claim 1, wherein the first compartment comprises a fresh food compartment of the refrigerator and the second compartment comprises a freezer compartment of the refrigerator.

3. The cooling system of claim 1, wherein the controller is configured to control the flow of coolant through the first evaporator to thereby control the cooling provided to the liquid storage thermal material stored in the reservoir.

4. The cooling system of claim 1, wherein the controller deters the compressor from providing coolant to the first evaporator when the liquid thermal storage material in the reservoir has received sufficient cooling capacity to be able to cool the plurality of features at a predetermined rate.

5. The cooling system of claim 1, wherein each of the plurality of features comprises one of a compartmental area of the refrigerator and a module of the refrigerator.

6. A cooling system for use in a refrigerator, comprising:

a first cooling loop having a compressor configured to compress coolant, a condenser operably connected to the compressor, a valving system operably connected to the condenser and configured to selectively provide coolant to a first evaporator thermally connected to a fresh food compartment and a second evaporator thermally connected to a freezer compartment;

a secondary cooling loop in non-fluid contact with the first cooling loop and having a reservoir that is thermally connected to the first evaporator and stores a liquid thermal storage material that receives excess cooling capacity from the first evaporator, a plurality of heat exchangers thermally connected to a plurality of features positioned within the fresh food compartment, and a pump operably connected to the reservoir that pumps the liquid thermal storage material to the plurality of heat exchangers to provide cooling to the plurality of features; and a controller configured to control the flow of coolant through the first evaporator to thereby control the cooling provided to the liquid storage thermal material stored in the reservoir; and wherein the plurality of heat exchangers are positioned relative to one another in the secondary cooling loop in a series, parallel, or series-parallel configuration;

wherein the secondary cooling loop further comprises a bypass circuit operably connected to the controller and configured to selectively provide the liquid thermal storage material to at least one of the plurality of heat exchangers while bypassing the other of the plurality of heat exchangers in instances where a thermal demand arises in the at least one of the plurality of features; and wherein the bypass circuit provides liquid thermal storage material to the plurality of heat exchangers based on the thermal demand of the plurality of features, wherein the plurality of features having the highest thermal demand are first to receive cooling.

7. The cooling system of claim 6, wherein the controller deters the compressor from providing coolant to the first evaporator when the liquid thermal storage material in the reservoir has received sufficient cooling capacity to be able to cool the plurality of features at a predetermined rate.

8. The cooling system of claim 6, wherein each of the plurality of features comprises one of a compartmental area of the refrigerator and a module of the refrigerator.

9. A cooling system for use in a refrigerator, comprising:

a first cooling loop having a compressor configured to compress coolant, a condenser operably connected to the compressor, a valving system operably connected to the condenser and configured to selectively provide coolant to a first evaporator thermally connected to a fresh food compartment and a second evaporator thermally connected to a freezer compartment;

a secondary cooling loop in non-fluid contact with the first cooling loop and having a reservoir that is thermally connected to the first evaporator and stores a liquid thermal storage material that receives excess cooling capacity from the first evaporator, a plurality of heat exchangers thermally connected to a plurality of features positioned within the fresh food compartment, a pump operably connected to the reservoir that pumps the liquid thermal storage material to the plurality of heat exchangers to provide cooling to the plurality of features, and a bypass circuit configured to selectively provide liquid thermal storage material to at least one of the plurality of heat exchangers while bypassing the other of the plurality of heat exchangers in instances where a thermal demand only arises in the at least one of the plurality of features; and a controller configured to control the flow of coolant through the first evaporator to thereby control the cooling provided to the liquid storage thermal material stored in the reservoir;

wherein plurality of heat exchangers are positioned relative to one another in the secondary cooling loop in a series, parallel, or series-parallel configuration; and wherein the bypass circuit is further configured to provide liquid thermal storage material to the plurality of heat exchangers based on the thermal demand of the plurality of features, wherein the plurality of features having the highest thermal demand are first to receive cooling.

10. The cooling system of claim 9, wherein the controller deters the compressor from providing coolant to the first evaporator when the liquid thermal storage material in the reservoir has received sufficient cooling capacity to be able to cool the plurality of features at a predetermined rate.

11. The cooling system of claim 9, wherein each of the plurality of features comprises one of a compartmental area of the refrigerator and a module of the refrigerator.

12. A method for providing cooling to a plurality of features positioned in a fresh food compartment of a refrigerator, comprising the steps of:

providing a first cooling loop having a compressor that compresses coolant, a condenser operably connected to the compressor, and a valving system that selectively provides coolant to a first evaporator thermally connected to the fresh food compartment of the refrigerator and a second evaporator thermally connected to a freezer compartment of the refrigerator;

providing a secondary cooling loop in non-fluid contact with the first cooling loop and having a reservoir thermally connected to the first evaporator that stores a liquid thermal storage material and a plurality of heat exchangers in thermal communication with the plurality of features;

cooling the liquid thermal storage material with the excess cooling capacity from the first evaporator;

pumping the liquid thermal storage material to the plurality of heat exchangers to provide cooling to the plurality of features; and using a controller to control the flow of coolant through the first evaporator to thereby control the cooling provided to the liquid storage thermal material stored in the reservoir;

wherein the plurality of heat exchangers are positioned relative to one another in the secondary cooling loop in a series, parallel, or series-parallel configuration;

wherein the secondary cooling loop further comprises a bypass circuit operably connected to the controller and configured to selectively provide the liquid thermal storage material to at least one of the plurality of heat exchangers while bypassing the other of the plurality of heat exchangers in instances where a thermal demand arises in the at least one of the plurality of features; and wherein the bypass circuit is further configured to provide liquid thermal storage material to the plurality of heat exchangers based on the thermal demand of the plurality of features, wherein the plurality of features having the highest thermal demand are first to receive cooling.

* * * * *